US010823514B2

(12) United States Patent
Zhang et al.

(10) Patent No.: US 10,823,514 B2
(45) Date of Patent: Nov. 3, 2020

(54) REINFORCER USED FOR PLATE HEAT EXCHANGER AND PLATE HEAT EXCHANGER

(71) Applicant: Danfoss Micro Channel Heat Exchanger (Jiaxing) Co., Ltd., Zhejiang (CN)

(72) Inventors: Zhifeng Zhang, Zhejiang (CN); Hongbing Chen, Zhejiang (CN); Hua Li, Zhejiang (CN); Pierre Olivier Pelletier, Zhejiang (CN); Shaoyi Chen, Zhejiang (CN)

(73) Assignee: Danfoss Micro Channel Heat Exchanger (Jiaxing) Co. Ltd, Zhejiang (CN)

( * ) Notice: Subject to any disclaimer, the term of this patent is extended or adjusted under 35 U.S.C. 154(b) by 88 days.

(21) Appl. No.: 16/072,549

(22) PCT Filed: Dec. 26, 2016

(86) PCT No.: PCT/CN2016/112052
§ 371 (c)(1),
(2) Date: Jul. 25, 2018

(87) PCT Pub. No.: WO2017/133349
PCT Pub. Date: Aug. 10, 2017

(65) Prior Publication Data

US 2019/0033015 A1 Jan. 31, 2019

(30) Foreign Application Priority Data

Feb. 4, 2016 (CN) ..... 2016 1 0081187

(51) Int. Cl.
*F28F 9/007* (2006.01)
*F28D 9/00* (2006.01)
*F28F 3/06* (2006.01)

(52) U.S. Cl.
CPC ..... *F28F 9/0075* (2013.01); *F28D 9/00* (2013.01); *F28D 9/005* (2013.01); *F28D 9/0031* (2013.01);
(Continued)

(58) Field of Classification Search
CPC ..... F28F 9/0075; F28F 9/00; F28F 2280/06; F28D 9/00; F28D 9/005; F28D 9/0031
See application file for complete search history.

(56) References Cited

U.S. PATENT DOCUMENTS

2005/0284620 A1* 12/2005 Thunwall ..... F28F 9/0075 165/167
2009/0229803 A1 9/2009 Lin
2016/0313073 A1* 10/2016 Larsson ..... F28F 9/002

FOREIGN PATENT DOCUMENTS

CN 201199140 Y 2/2009
CN 102042772 A 5/2011
(Continued)

OTHER PUBLICATIONS

International Search Report for PCT Serial No. PCT/CN2016/112052 dated Mar. 30, 2017.
(Continued)

*Primary Examiner* — Jon T. Schermerhorn, Jr.
(74) *Attorney, Agent, or Firm* — McCormick, Paulding & Huber PLLC

(57) ABSTRACT

Provided are a reinforcer (30) used for a plate heat exchanger (100) and a plate heat exchanger (100), the reinforcer (30) being used to reinforce an area around an opening (13) of at least one heat exchange plate (10). The plate heat exchanger (100) comprises multiple heat exchange plates (10); a heat exchange space formed between adjacent heat exchange plates (10) of the multiple heat exchange plates (10); a heat exchange channel (11) formed between the heat exchange plates (10), wherein the heat
(Continued)

exchange channel (11) is used for a heat exchange medium to flow into or out of the plate heat exchanger (100), and is constituted by openings (13) in the multiple heat exchange plates (10); and a reinforcer (30), used to reinforce an area around an opening (13) in at least one heat exchange plate (10). The plate heat exchanger (100) can alleviate or prevent deformation or cracking of a backing plate (18) and a heat exchange plate (10) of the plate heat exchanger (100), especially the two heat exchange plates (10) adjacent to the backing plate (18), in the area around the heat exchange channel (11).

2 Claims, 13 Drawing Sheets

(52) U.S. Cl.
CPC ..... *F28F 3/06* (2013.01); *F28F 2225/04* (2013.01); *F28F 2280/06* (2013.01)

(56) References Cited

FOREIGN PATENT DOCUMENTS

| | | | |
|---|---|---|---|
| CN | 201955011 | U | 8/2011 |
| CN | 102245991 | A | 11/2011 |
| CN | 202195728 | U | 4/2012 |
| CN | 205784793 | U | 12/2016 |
| DE | 202008004655 | U1 | 11/2008 |
| FR | 2850740 | A1 | 8/2004 |
| GB | 654395 | | 6/1951 |
| JP | S62200191 | A | 9/1987 |
| JP | H1194487 | A | 4/1999 |
| JP | 3141845 | U9 | 5/2008 |
| JP | 2013178078 | A | 9/2013 |

OTHER PUBLICATIONS

Supplementary European Search Report for Serial No. EP 16889155.4 dated Sep. 13, 2019.

* cited by examiner

REINFORCER USED FOR PLATE HEAT EXCHANGER AND PLATE HEAT EXCHANGER

CROSS-REFERENCE TO RELATED APPLICATIONS

This application is a National Stage application of International Patent Application No. PCT/CN2016/112052, filed on Dec. 26, 2016, which claims priority to Chinese Patent Application No. 201610081187.1, filed on Feb. 4, 2016, each of which is hereby incorporated by reference in its entirety.

TECHNICAL FIELD

The embodiments of the present invention relate to a reinforcer for a plate heat exchanger, and a plate heat exchanger.

BACKGROUND

The backplate and heat exchanging plates of a traditional plate heat exchanger, and in particular the two heat exchanging plates close to the backplate, will be deformed or crack in the area around the heat exchanging channel.

SUMMARY

The objective of the embodiments of the present invention is to provide a reinforcer for a plate heat exchanger, and a plate heat exchanger. Said reinforcer for a plate heat exchanger and the plate heat exchanger can, for example, alleviate or prevent the deformation or cracking of the backplate and heat exchanging plates of the plate heat exchanger, and in particular the two heat exchanging plates close to the backplate in the area around the heat exchanging channel.

According to the embodiments of the present invention, a reinforcer for a plate heat exchanger is provided, said plate heat exchanger comprises a plurality of heat exchanging plates, a heat exchanging space formed between adjacent heat exchanging plates of said plurality of heat exchanging plates, and a heat exchanging channel formed in the heat exchanging plates, said heat exchanging channel is used for a heat exchanging medium to flow into or out of the heat exchanger, and is constituted by openings in the plurality of heat exchanging plates, and said reinforcer is used to reinforce the area around the opening of at least one heat exchanging plate.

According to the embodiments of the present invention, said reinforcer for a plate heat exchanger comprises a plate-shaped body and a projection portion protruding from the center of the plate-shaped body.

According to the embodiments of the present invention, said reinforcer has a reinforcer channel and said reinforcer channel is used to connect said heat exchanging channel to the heat exchanging space between two adjacent heat exchanging plates.

According to the embodiments of the present invention, said reinforcer further has a central hole, and the heat exchanging medium flowing along said heat exchanging channel can flow through said central hole.

According to the embodiments of the present invention, said reinforcer channel extends from a position inside the opening of said heat exchanging plate to a position outside the opening of said heat exchanging plate.

According to the embodiments of the present invention, said reinforcer channel is a groove extending from the outer circumference of said reinforcer to the center of said reinforcer.

According to the embodiments of the present invention, said groove passes through the entire thickness of said reinforcer, or, the depth of said groove is smaller than the thickness of said reinforcer.

According to the embodiments of the present invention, said reinforcer has a plate-shaped body and a plurality of projections, said plurality of projections are located on the circumference of the plate-shaped body and extend from the plate-shaped body to one side of said plate-shaped body in a direction perpendicular to the plate-shaped body, and a reinforcer channel is formed between adjacent projections of said plurality of projections.

According to the embodiments of the present invention, at least one of said plurality of projections has an opening, and said opening faces the direction from the center of the plate-shaped body of said reinforcer to the circumference of the plate-shaped body of said reinforcer.

According to the embodiments of the present invention, said plurality of projections have cylindrical formations, and the ends far away from the plate-shaped body are closed.

According to the embodiments of the present invention, said reinforcer is roughly in the shape of a disk.

According to the embodiments of the present invention, a plate heat exchanger is provided, said plate heat exchanger comprises a plurality of heat exchanging plates, a heat exchanging space formed between adjacent heat exchanging plates of said plurality of heat exchanging plates, a heat exchanging channel formed in the heat exchanging plates, said heat exchanging channel being used for a heat exchanging medium to flow into or out of the heat exchanger, and being constituted by openings in the plurality of heat exchanging plates, and a reinforcer used to reinforce the area around the opening of at least one heat exchanging plate.

According to the embodiments of the present invention, said plate heat exchanger further comprises a backplate, said backplate is provided on one side, opposite the channel opening of said heat exchanging channel, of the heat exchanger, said reinforcer has a plate-shaped body and a projection portion protruding from the center of the plate-shaped body, said plate-shaped body is provided between the backplate and a first heat exchanging plate adjacent to the backplate, the projection portion protrudes towards the side of the channel opening, and said plate-shaped body is in direct contact with and is connected to at least one of the backplate and the first heat exchanging plate.

According to the embodiments of the present invention, the projection portion extends through the opening of the first heat exchanging plate and the opening of a second heat exchanging plate adjacent to the first heat exchanging plate into between the second heat exchanging plate and a third heat exchanging plate adjacent to the second heat exchanging plate.

According to the embodiments of the present invention, a concave portion is provided on said second heat exchanging plate and third heat exchanging plate to accommodate said projection portion.

According to the embodiments of the present invention, said reinforcer is provided between two adjacent heat exchanging plates and is in direct contact with and is connected to at least one of said two adjacent heat exchanging plates, said reinforcer has a reinforcer channel, and said reinforcer channel is used to connect said heat exchanging channel to the heat exchanging space between said two adjacent heat exchanging plates.

According to the embodiments of the present invention, said reinforcer further has a central hole, and the heat exchanging medium flowing along said heat exchanging channel can flow through said central hole.

According to the embodiments of the present invention, said reinforcer channel extends from a position inside the opening of said heat exchanging plate to a position outside the opening of said heat exchanging plate.

According to the embodiments of the present invention, said reinforcer channel is a groove extending from the outer circumference of said reinforcer to the center of said reinforcer.

According to the embodiments of the present invention, said groove passes through the entire thickness of said reinforcer, or, the depth of said groove is smaller than the thickness of said reinforcer.

According to the embodiments of the present invention, said reinforcer has a plate-shaped body and a plurality of projections, said plurality of projections are located on the circumference of the plate-shaped body and extend from the plate-shaped body to one side of said plate-shaped body in a direction perpendicular to the plate-shaped body, and a reinforcer channel is formed between adjacent projections of said plurality of projections.

According to the embodiments of the present invention, at least one of said plurality of projections has an opening, and said opening faces the direction from the center of the plate-shaped body of said reinforcer to the circumference of the plate-shaped body of said reinforcer.

According to the embodiments of the present invention, said plurality of projections have cylindrical formations, and the ends far away from the plate-shaped body are closed.

According to the embodiments of the present invention, said reinforcer is roughly in the shape of a disk.

According to the embodiments of the present invention, said reinforcer is provided between the second heat exchanging plate and the third heat exchanging plate on one side, opposite the channel opening of said heat exchanging channel, of the heat exchanger.

The reinforcer for a plate heat exchanger and the plate heat exchanger in the embodiments of the present invention can, for example, alleviate or prevent the deformation or cracking of the backplate and heat exchanging plates of the plate heat exchanger, and in particular the two heat exchanging plates close to the backplate in the area around the heat exchanging channel.

DETAILED DESCRIPTION

Figure 1:
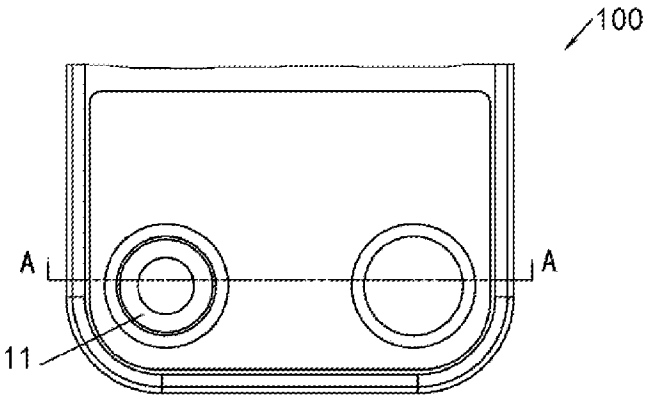
FIG. 1 is a schematic front view of the plate heat exchanger according to a first embodiment of the present invention.
Figure 2:
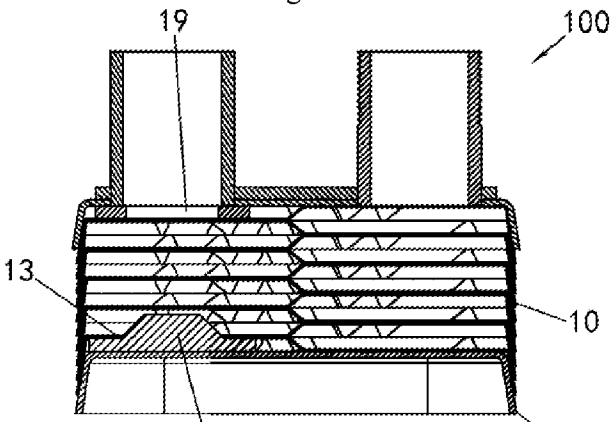
FIG. 2 is a cutaway view of the plate heat exchanger according to the first embodiment of the present invention along the line AA in FIG. 1.
Figure 3:
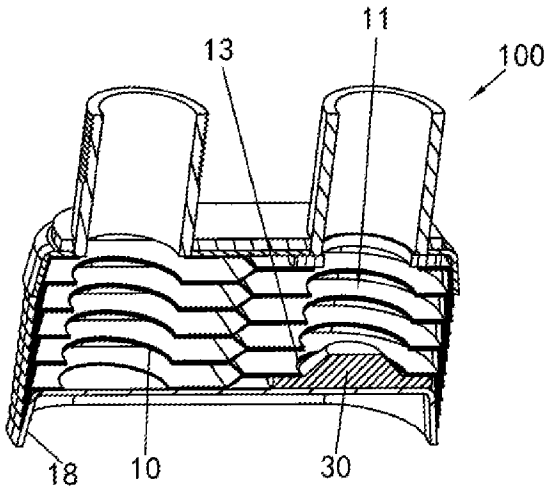
FIG. 3 is a cutaway perspective view of the plate heat exchanger according to the first embodiment of the present invention along the line AA in FIG. 1.
Figure 6:
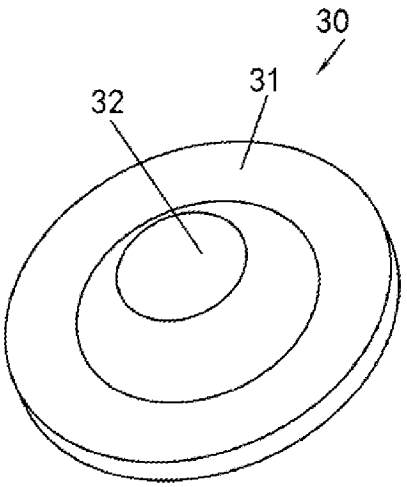
FIG. 6 is a perspective view of the reinforcer of the plate heat exchanger according to the first embodiment of the present invention.
Figure 5:
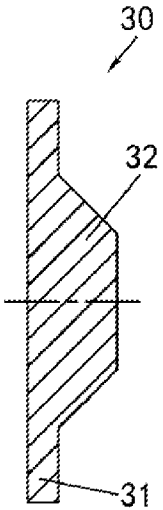
FIG. 5 is a cutaway view of the reinforcer of the plate heat exchanger according to the first embodiment of the present invention along the line AA in FIG. 4.
Figure 4:
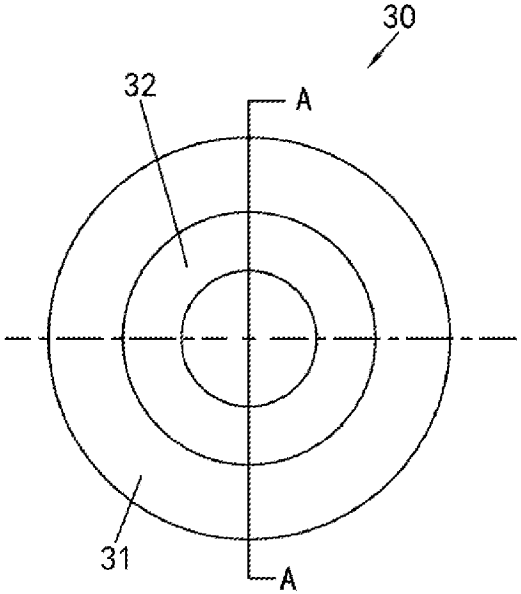
FIG. 4 is a schematic front view of the reinforcer of the plate heat exchanger according to the first embodiment of the present invention.
Figure 7:
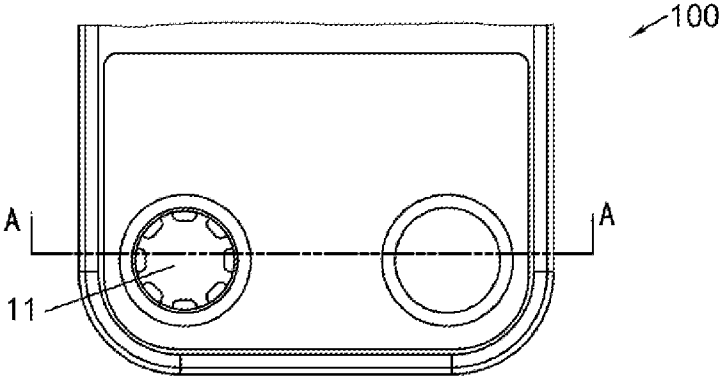
FIG. 7 is a schematic front view of the plate heat exchanger according to a second embodiment of the present invention.
Figure 8:
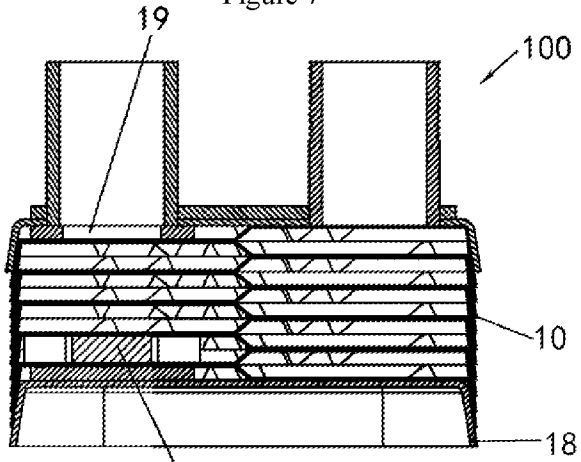
FIG. 8 is a cutaway view of the plate heat exchanger according to the second embodiment of the present invention along the line AA in FIG. 7.
Figure 9:
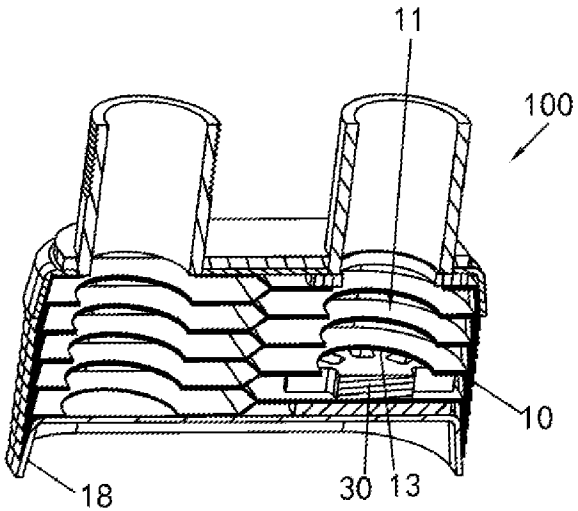
FIG. 9 is a cutaway perspective view of the plate heat exchanger according to the second embodiment of the present invention along the line AA in FIG. 7.
Figure 12:
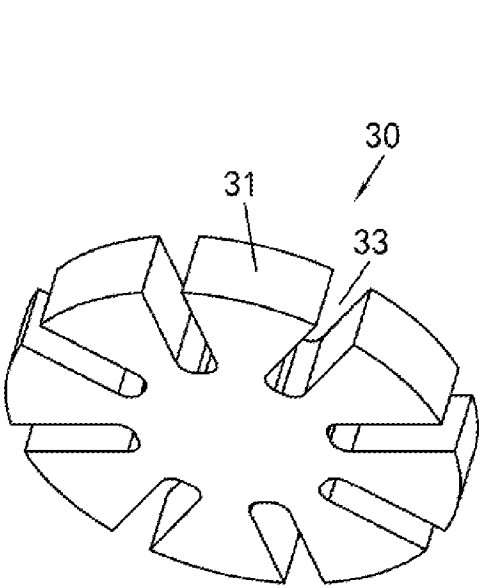
FIG. 12 is a schematic perspective view of the reinforcer of the plate heat exchanger according to the second embodiment of the present invention.
Figure 11:
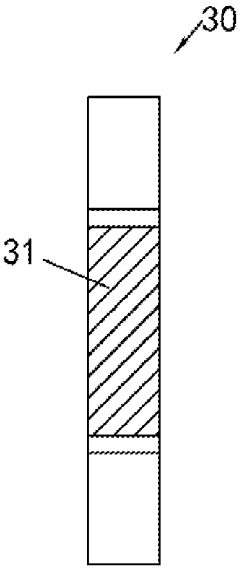
FIG. 11 is a cutaway view of the reinforcer of the plate heat exchanger according to the second embodiment of the present invention along the line AA in FIG. 10.
Figure 10:
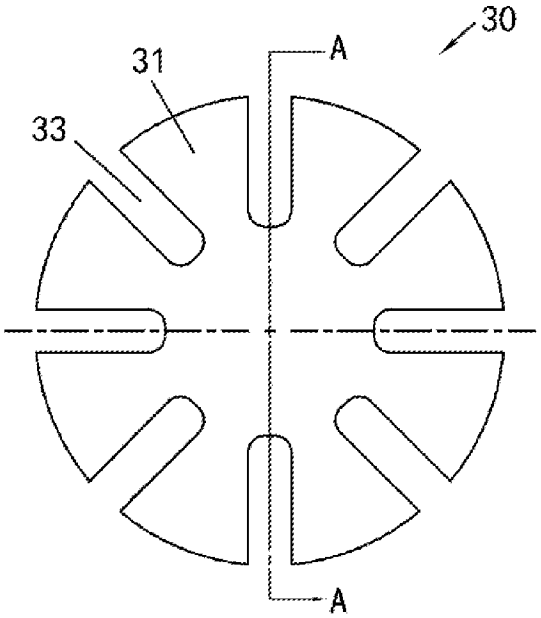
FIG. 10 is a schematic front view of the reinforcer of the plate heat exchanger according to the second embodiment of the present invention.
Figure 13:
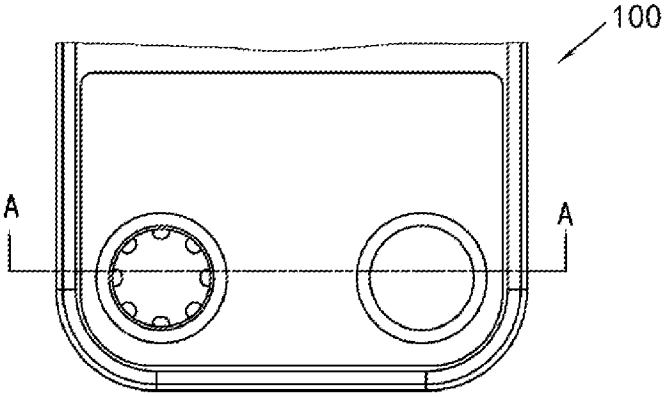
FIG. 13 is a schematic front view of the plate heat exchanger according to a third embodiment of the present invention.
Figure 14:
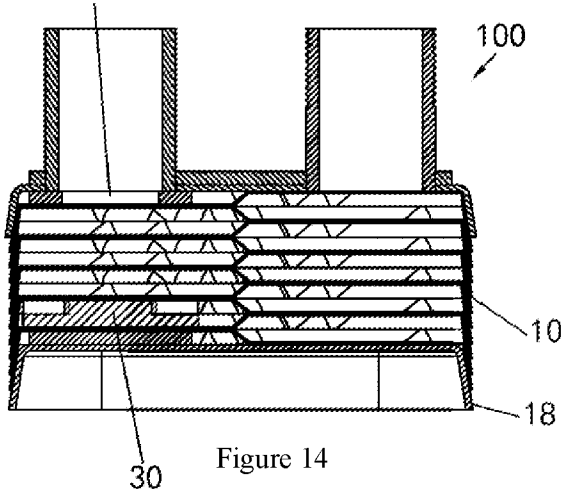
FIG. 14 is a cutaway view of the plate heat exchanger according to the third embodiment of the present invention along the line AA in FIG. 13.
Figure 15:
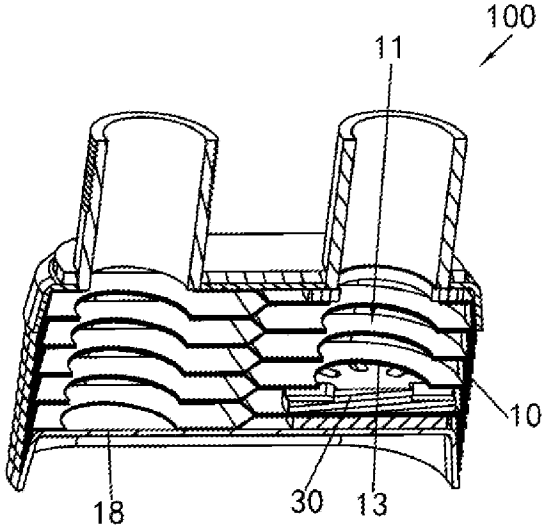
FIG. 15 is a cutaway perspective view of the plate heat exchanger according to the third embodiment of the present invention along the line AA in FIG. 13.
Figure 16:
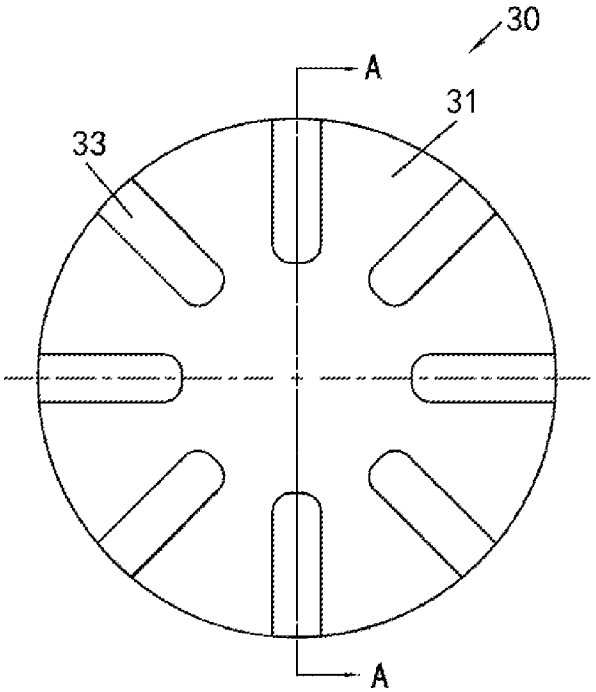
FIG. 16 is a schematic front view of the reinforcer of the plate heat exchanger according to the third embodiment of the present invention.
Figure 17:
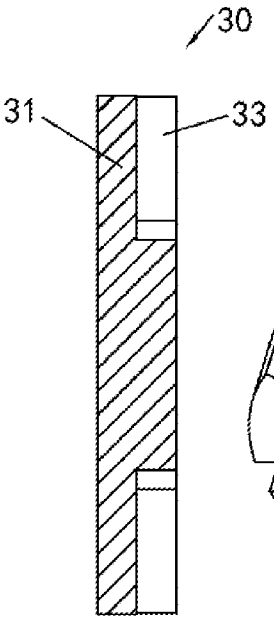
FIG. 17 is a cutaway view of the reinforcer of the plate heat exchanger according to the third embodiment of the present invention along the line AA in FIG. 16.
Figure 18:
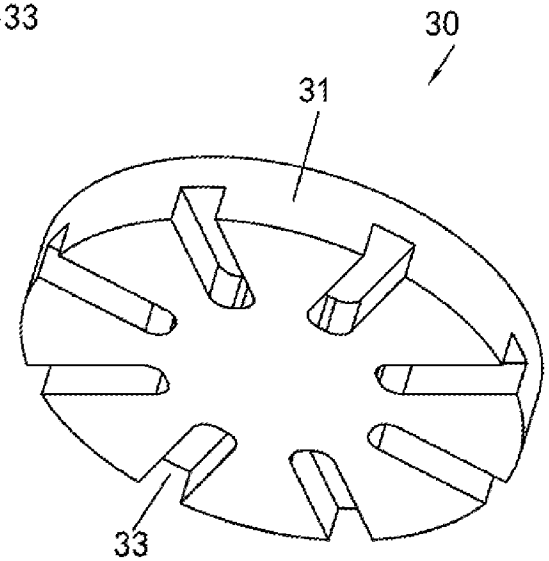
FIG. 18 is a schematic perspective view of the reinforcer of the plate heat exchanger according to the third embodiment of the present invention.
Figure 19:
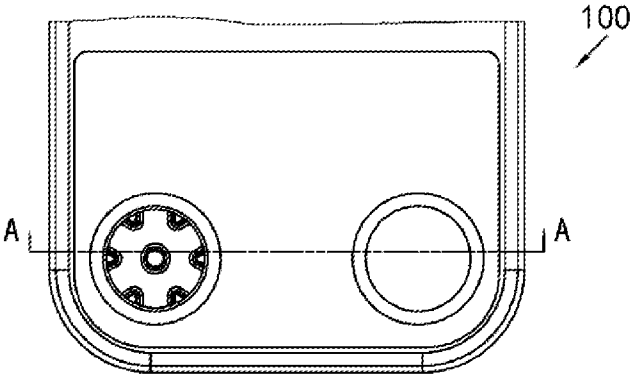
FIG. 19 is a schematic front view of the plate heat exchanger according to a fourth embodiment of the present invention.
Figure 20:
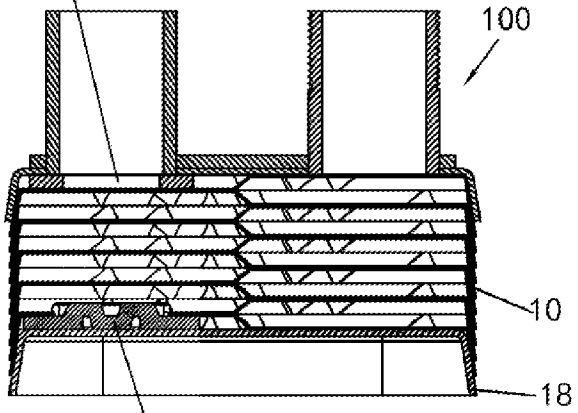
FIG. 20 is a cutaway view of the plate heat exchanger according to the fourth embodiment of the present invention along the line AA in FIG. 19.
Figure 21:
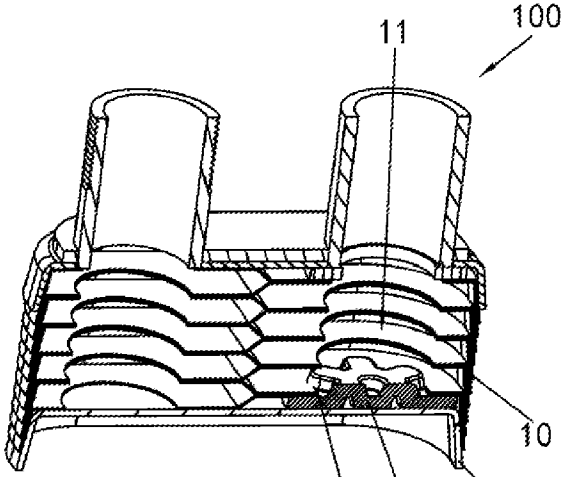
FIG. 21 is a cutaway perspective view of the plate heat exchanger according to the fourth embodiment of the present invention along the line AA in FIG. 19.
Figure 24:
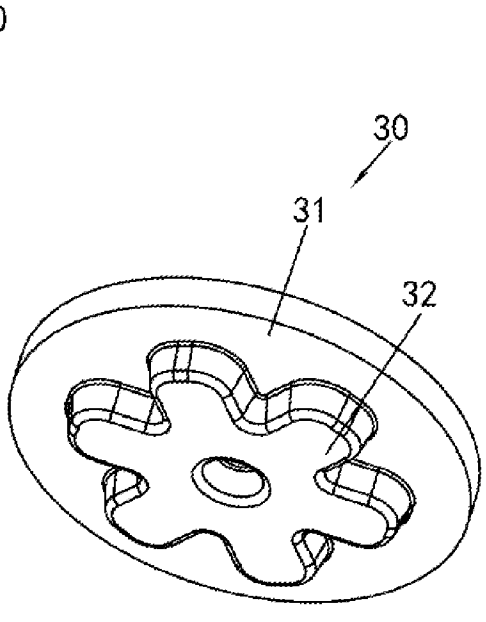
FIG. 24 is a perspective view of the reinforcer of the plate heat exchanger according to the fourth embodiment of the present invention.
Figure 23:
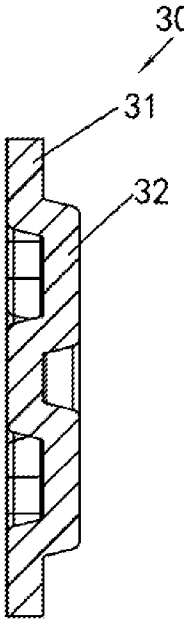
FIG. 23 is a cutaway view of the reinforcer of the plate heat exchanger according to the fourth embodiment of the present invention along the line AA in FIG. 22.
Figure 22:
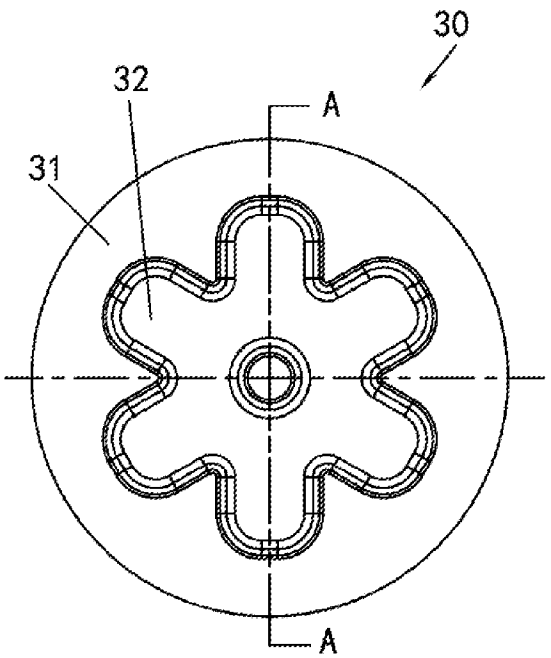
FIG. 22 is a schematic front view of the reinforcer of the plate heat exchanger according to the fourth embodiment of the present invention.
Figure 25:
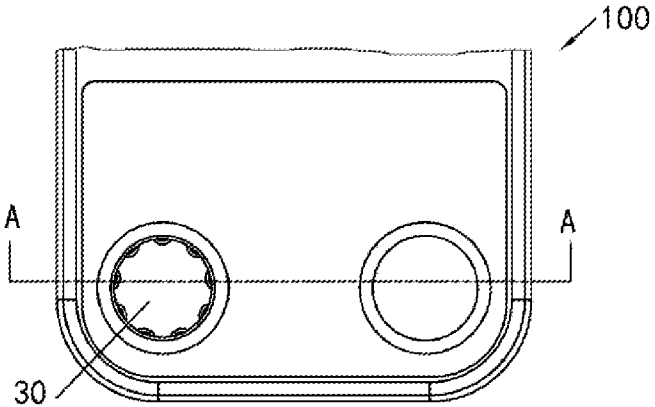
FIG. 25 is a schematic front view of the plate heat exchanger according to a fifth embodiment of the present invention.
Figure 26:
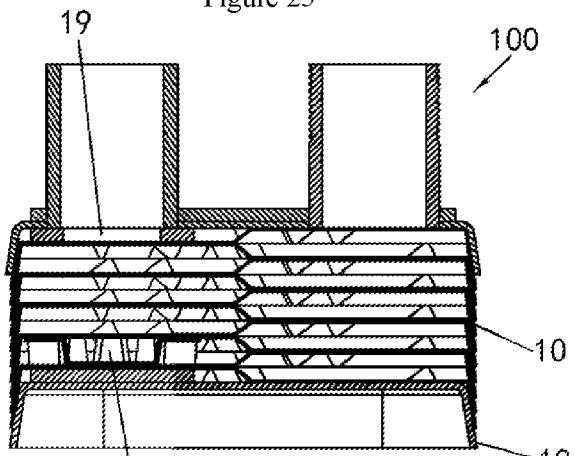
FIG. 26 is a cutaway view of the plate heat exchanger according to the fifth embodiment of the present invention along the line AA in FIG. 25.
Figure 27:
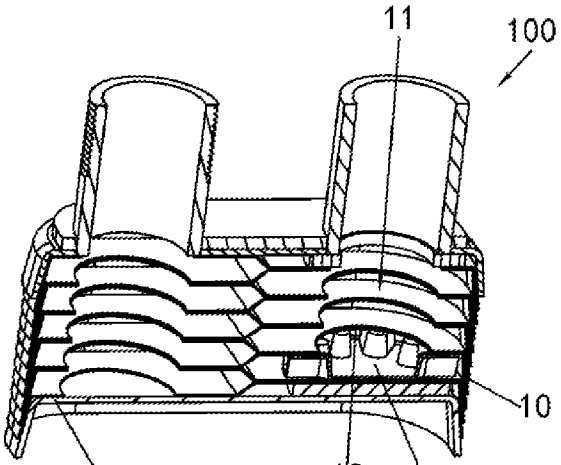
FIG. 27 is a cutaway perspective view of the plate heat exchanger according to the fifth embodiment of the present invention along the line AA in FIG. 25.
Figure 30:
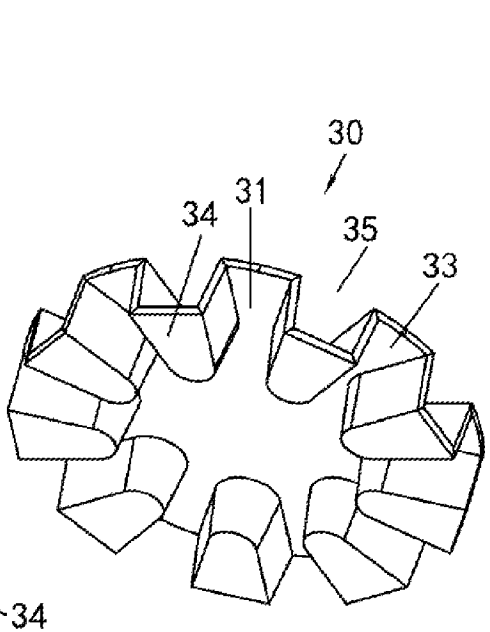
FIG. 30 is a perspective view of the reinforcer of one exemplary plate heat exchanger according to the fifth embodiment of the present invention.
Figure 29:
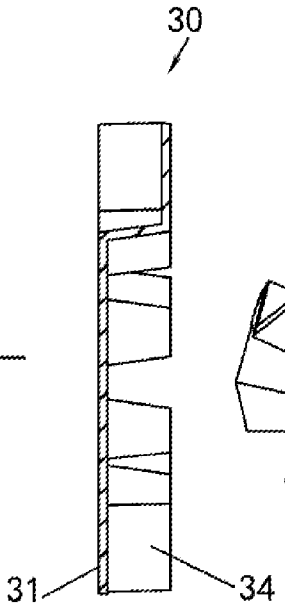
FIG. 29 is a cutaway view of the reinforcer of one exemplary plate heat exchanger according to the fifth embodiment of the present invention along the line AA in FIG. 28.
Figure 28:
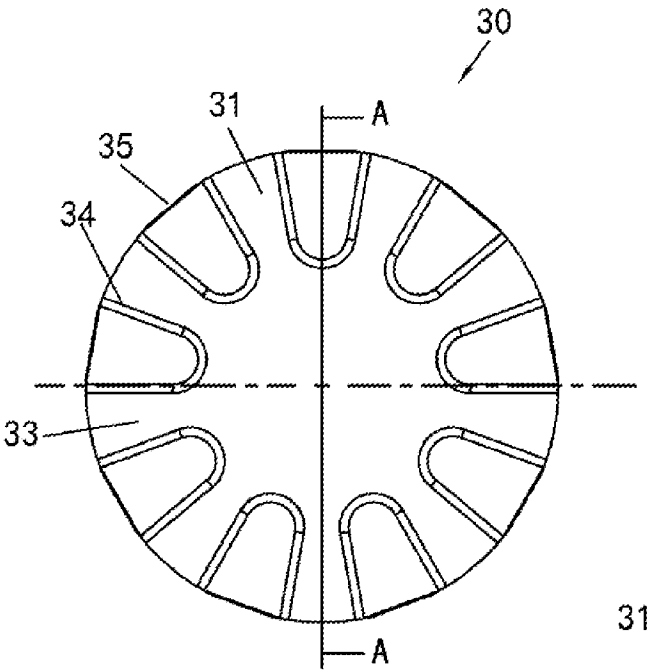
FIG. 28 is a schematic front view of the reinforcer of one exemplary plate heat exchanger according to the fifth embodiment of the present invention.

The following further describes the present invention in combination with the drawings and particular embodiments.

As shown in FIGS. 1 to 39, a plate heat exchanger 100 in the embodiments of the present invention comprises a plurality of heat exchanging plates 10, a heat exchanging space formed between adjacent heat exchanging plates 10 of said plurality of heat exchanging plates 10, a heat exchanging channel 11 formed in the heat exchanging plates 10, said heat exchanging channel 11 being used for a heat exchanging medium to flow into or out of the heat exchanger 100, and said heat exchanging channel 11 being constituted by the openings 13 of the plurality of heat exchanging plates 10, and a reinforcer 30 used to reinforce the area around the opening 13 of at least one heat exchanging plate 10. Said reinforcer 30 can roughly be in the shape of a disk and can be formed from sheet metal.

As shown in FIGS. 1 to 6 and FIGS. 19 to 24, the plate heat exchanger 100 in some embodiments of the present invention further comprises a backplate 18, said backplate 18 is provided on one side, opposite the channel opening 19 of said heat exchanging channel 11, of the heat exchanger 100, said reinforcer 30 has a plate-shaped body 31 and a projection portion 32 protruding from the center of the plate-shaped body 31, said plate-shaped body 31 is provided between the backplate 18 and a first heat exchanging plate 10 adjacent to the backplate 18, and the projection portion 32 protrudes towards the side of the channel opening 19. Said plate-shaped body 31 is in direct contact with and is connected, for example, welded, to at least one of the backplate 18 and the first heat exchanging plate 10. For example, said plate-shaped body 31 is in direct contact with and is welded to the backplate 18 and the first heat exchanging plate 10. The projection portion 32 can extend through the opening 13 of the first heat exchanging plate 10 and the opening 13 of a second heat exchanging plate 10 adjacent to the first heat exchanging plate 10 into between the second heat exchanging plate 10 and a third heat exchanging plate 10 adjacent to the second heat exchanging plate 10, or, an opening is provided on said second heat exchanging plate 10 and third heat exchanging plate 10 to accommodate said projection portion 32. The space between the backplate 18 and the first heat exchanging plate 10 can be sealed off from and isolated from said heat exchanging channel 11 by the reinforcer 30. In some embodiments of the present invention, the heat exchanging space between the first heat exchanging plate 10 and the second heat exchanging plate 10 is sealed off from and isolated from said heat exchanging channel 11, and the heat exchanging space between the second heat exchanging plate 10 and the third heat exchanging plate 10 is connected to said heat exchanging channel 11.

As shown in FIGS. 7 to 18 and FIGS. 25 to 39, in some embodiments of the present invention, said reinforcer 30 is provided between two adjacent heat exchanging plates 10 (for example, between the second heat exchanging plate 10 and the third heat exchanging plate 10), and is in direct contact with and is connected, for example, welded, to at least one of said two adjacent heat exchanging plates 10. For example, the reinforcer 30 is in direct contact with and is welded to said two adjacent heat exchanging plates 10. Said reinforcer 30 has a reinforcer channel 33 and said reinforcer channel 33 is used to connect said heat exchanging channel 11 to the heat exchanging space between said two adjacent heat exchanging plates 10. In addition, a plate-shaped reinforcer, for example, a disk-shaped reinforcer, can be provided between the backplate 18 and the first heat exchanging plate 10 adjacent to the backplate 18.

As shown in FIGS. 34 to 39, said reinforcer 30 in some embodiments of the present invention further has a central hole 36, and the heat exchanging medium flowing along said heat exchanging channel 11 can flow through said central hole 36. Thus, said reinforcer 30 can be provided between two adjacent heat exchanging plates 10, and the heat exchanging space between the two heat exchanging plates is connected to said heat exchanging channel 11.

As shown in FIGS. 7 to 18 and FIGS. 25 to 39, in some embodiments of the present invention, said reinforcer channel 33 extends from a position inside the opening 13 of said heat exchanging plate 10 to a position outside the opening 13 of said heat exchanging plate 10.

As shown in FIG. 11, FIG. 12, and FIGS. 16 to 18, said reinforcer channel 33 can be a groove extending from the outer circumference of said reinforcer 30 to the center of said reinforcer 30. Said groove can pass through the entire thickness of said reinforcer 30 (See FIGS. 11 and 12), or, the depth of said groove is smaller than the thickness of said reinforcer 30 (See FIGS. 16 to 18).

Figures 31, 32, 33:
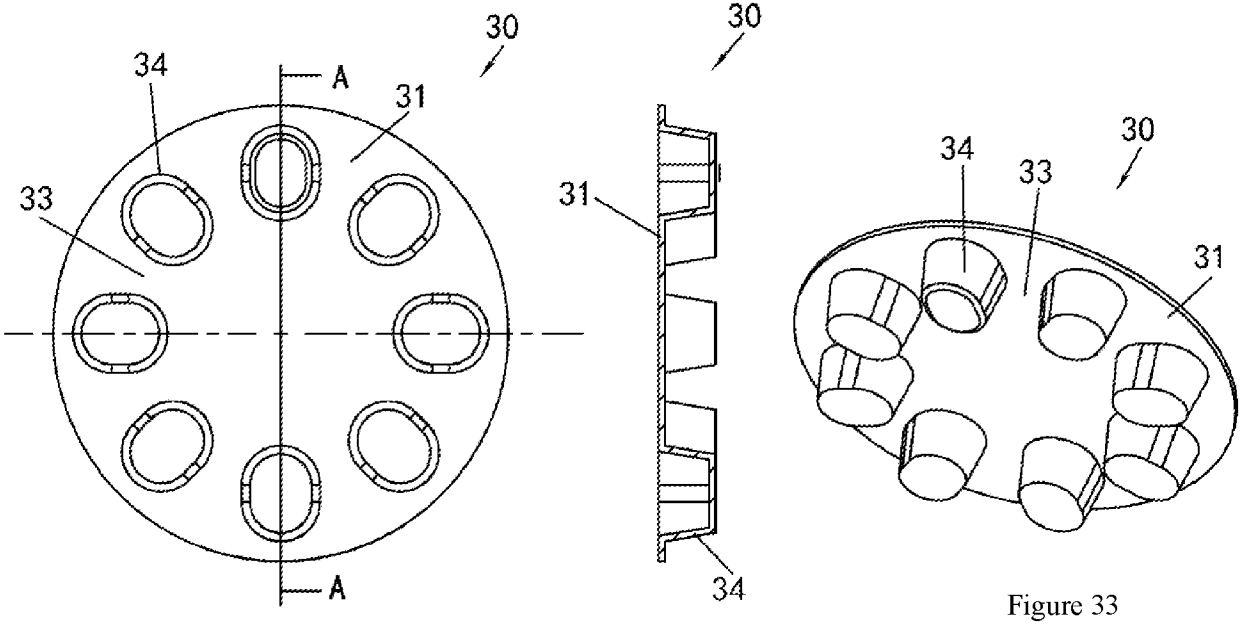
FIG. 31 is a schematic front view of the reinforcer of another exemplary plate heat exchanger according to the fifth embodiment of the present invention.
FIG. 32 is a cutaway view of the reinforcer of another exemplary plate heat exchanger according to the fifth embodiment of the present invention along the line AA in FIG. 31.
FIG. 33 is a perspective view of the reinforcer of another exemplary plate heat exchanger according to the fifth embodiment of the present invention.
Figure 36:
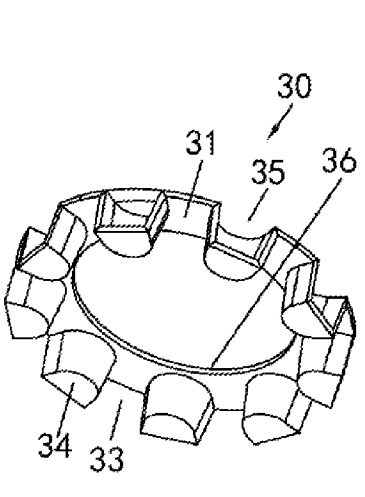
FIG. 36 is a perspective view of the reinforcer of the plate heat exchanger according to the sixth embodiment of the present invention.
Figure 35:
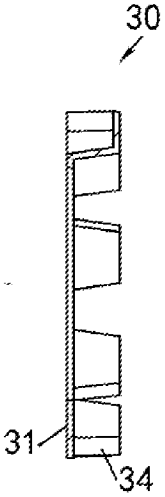
FIG. 35 is a cutaway view of the reinforcer of the plate heat exchanger according to the sixth embodiment of the present invention along the line AA in FIG. 34.
Figure 34:
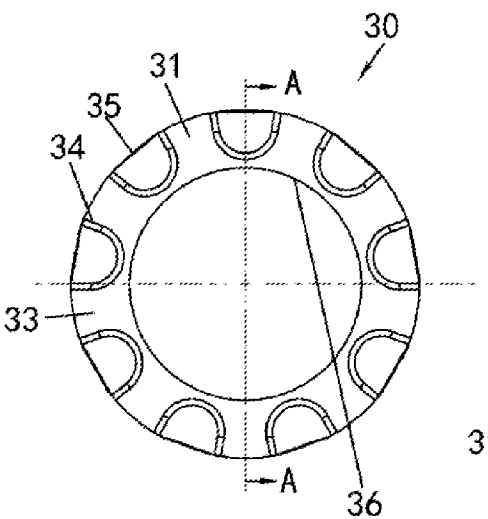
FIG. 34 is a schematic front view of the reinforcer of the plate heat exchanger according to a sixth embodiment of the present invention.
Figure 37:
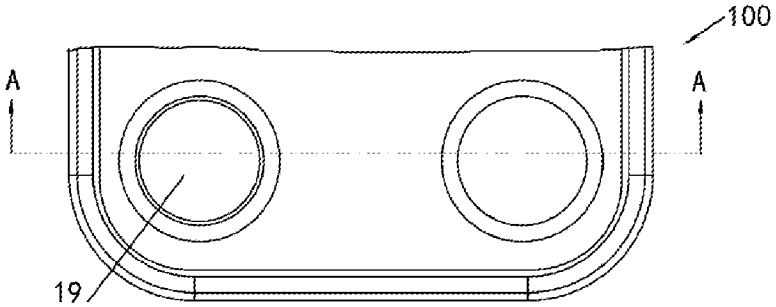
FIG. 37 is a schematic front view of the plate heat exchanger according to the sixth embodiment of the present invention.
Figure 38:
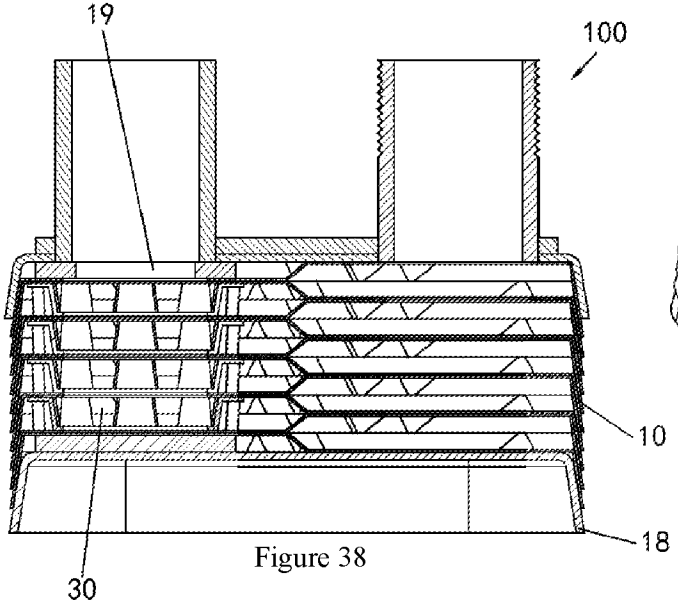
FIG. 38 is a cutaway view of the plate heat exchanger according to the sixth embodiment of the present invention along the line AA in FIG. 37.
Figure 39:
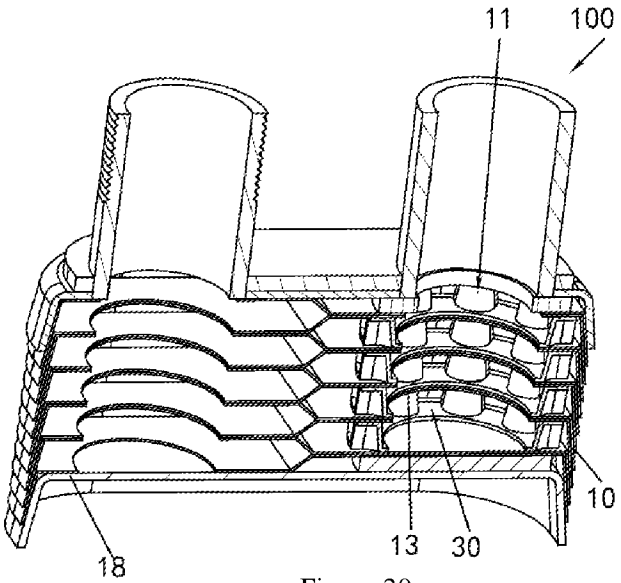
FIG. 39 is a cutaway perspective view of the plate heat exchanger according to the sixth embodiment of the present invention along the line AA in FIG. 37.

As shown in FIGS. 25 to 39, in some embodiments of the present invention, said reinforcer 30 has a plate-shaped body 31 and a plurality of projections 34, said plurality of projections 34 are located on the circumference of the plate-shaped body 31 and extend from the plate-shaped body 31 to one side of said plate-shaped body 31 in a direction perpendicular to the plate-shaped body 31, and a reinforcer channel 33 is formed between adjacent projections 34 of said plurality of projections 34. As shown in FIGS. 28 to 30, and FIGS. 34 to 37, at least one of said plurality of projections 34 has an opening 35, and said opening 35 faces the direction from the center of the plate-shaped body 31 of said reinforcer 30 to the circumference of the plate-shaped body 31 of said reinforcer 30. As shown in FIGS. 31 to 33, said plurality of projections 34 have cylindrical formations and the ends far away from the plate-shaped body 31 can be closed.

The reinforcer for a plate heat exchanger and the plate heat exchanger in the embodiments of the present invention can, for example, alleviate or prevent the deformation or cracking of the backplate and heat exchanging plates of the plate heat exchanger, and in particular the two heat exchanging plates close to the backplate.

In addition, the reinforcer for a plate heat exchanger and the plate heat exchanger in the embodiments of the present invention can reduce the cost of the heat exchanger and enhance the strength of the heat exchanger without influencing the performance of the heat exchanger. In addition, the reinforcer for a plate heat exchanger and the plate heat exchanger in the embodiments of the present invention can be easily implemented.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A plate heat exchanger, comprising:

a plurality of heat exchanging plates;

a heat exchanging space formed between adjacent heat exchanging plates of said plurality of heat exchanging plates;

a heat exchanging channel formed in the heat exchanging plates, said heat exchanging channel being used for a heat exchanging medium to flow into or out of the heat exchanger and being constituted by openings in the plurality of heat exchanging plates;

a reinforcer used to reinforce the area around the opening of at least one heat exchanging plate; and a backplate, said backplate being provided on one side, opposite a channel opening of said heat exchanging channel, of the heat exchanger, said reinforcer having a plate-shaped body and a projection portion protruding from a center of the plate-shaped body, said plate-shaped body being provided between the backplate and a first heat exchanging plate adjacent to the backplate, the projection portion protruding towards the side of the channel opening, and said plate-shaped body being in direct contact with and connected to at least one of the backplate and the first heat exchanging plate.

2. The plate heat exchanger as claimed in claim 1, wherein:

the projection portion extends through the opening of the first heat exchanging plate and the opening of the second heat exchanging plate adjacent to the first heat exchanging plate into between the second heat exchanging plate and a third heat exchanging plate adjacent to the second heat exchanging plate.

* * * * *